United States Patent [19]

Goryohara

[11] Patent Number: 4,739,364

[45] Date of Patent: Apr. 19, 1988

[54] ROLL PAPER FEEDING APPARATUS FOR ELECTROPHOTOGRAPHIC PROCESSING MACHINE

[75] Inventor: Yoshiyuki Goryohara, Kanagawa, Japan

[73] Assignee: Fuji Photo Film Co., Ltd., Kanagawa, Japan

[21] Appl. No.: 69,807

[22] Filed: Jul. 6, 1987

[30] Foreign Application Priority Data

Jul. 3, 1986 [JP] Japan ..... 61-157009

[51] Int. Cl.[4] ..... G03G 15/00

[52] U.S. Cl. ..... 355/13; 355/16; 355/29

[58] Field of Search ..... 355/13, 16, 29, 3 SH; 83/203, 205

[56] References Cited

U.S. PATENT DOCUMENTS

| | | | |
|---|---|---|---|
| 3,820,892 | 6/1974 | Boschet | 355/13 |
| 3,951,023 | 4/1976 | Ashburner | 355/13 X |
| 4,248,520 | 2/1981 | Kurita et al. | 355/13 X |

*Primary Examiner*—R. L. Moses

*Attorney, Agent, or Firm*—Sughrue, Mion, Zinn, Macpeak & Seas

[57] ABSTRACT

The disadvantages derived from a conventional electrophotographic processing machine are that the length of the forward end of the master paper as cut is more than about 600 mm and this increases the amount of loss thereof, thus making the photographic processing expensive. An operation for disposing of the tip of the master paper as wasted paper every time a start switch is depressed requires much labor and renders operability poor. This also requires shifting of the position of the paper tip after cutting upper and lower rolls so that difficulty is involved in carrying out photographic processing simultaneously with such shifting. A roll paper feeding apparatus according to the invention is capable of shortening the tip of the master paper which has to be disposed of as waste at low cost without requiring discharge of the paper tip every time the paper is cut, thus helping the operator. The paper tip is normally positioned on standby such as to make enable photographic processing to be started simultaneously with shifting of the upper and lower rolls.

8 Claims, 3 Drawing Sheets

ROLL PAPER FEEDING APPARATUS FOR ELECTROPHOTOGRAPHIC PROCESSING MACHINE

BACKGROUND OF THE INVENTION

This invention relates to a roll paper feeding apparatus for an electrophotographic processing machine which is adapted to prepare a negative plate (offset master) for offset printing.

Electrophotographic processing machines are employed for preparing offset masters by means of an electrophotographic method and its use is now widespread in the field of printing and presswork due to the simplicity of handling and opertion thereof and the like. A master paper (photosensitive paper) used for an offset master comprises lining, underlining and photoconductive layers successively laminated on a support and is electrified so as to provide the photoconductive layer with photosensitiveness.

FIG. 1 is a structural view showing in section one form of a console type electrophotographic processing machine which has been conventionally used. As shown, the console type electrophotographic processing machine has a main body 40 which is provided upwardly and forwardly thereof (in the direction of an arrow F as shown) with a photographing means 41. The photographing means 41 is formed forwardly of the top thereof with a document tray 411 for holding documents (not shown) and is adapted to prepare a printing stencil plate. The document tray 411 is designed to open forwardly and rearwardly of the main body 40 such as to carry documents thereon. The document tray 411 is provided downwardly thereof with an exposure lamp 412 adapted to expose the document surface carried on the tray, and a photographic lens 413 for condensing photographic light which is exposed by the exposure lamp 412 and reflected by the document surface for image formation. The photographing means 41 is composed of the document tray 411, the exposure lamp 412 and the photographic lens 413.

On the other hand, the main body 40 of the electrophotographic processing machine is provided upwardly and rearwardly thereof (in the direction of an arrow R as shown) with a master paper supply unit 42 for receiving therein a roll of photographic processing copying paper (hereinafter referred to as master paper) such as paper formed of for example, zinc oxide. On the top of the master paper supply unit 42 is mounted a master paper loading cover 421 which is opened when the roll of master paper P is loaded. The master paper supply unit 42 is also provided with a cutter 422 for cutting a predetermined length of the master paper P to be fed in the direction of an exposing means and a corona charged device 423 connected thereto for electrifying the master paper P as cut. A suction type exposure bed 43 is provided downwardly of the master paper supply unit 42 such as to hold the master paper P which is thus cut in predetermined lengths, electrified and conveyed in the direction of an arrow C as shown for image formation. Downwardly of the photographic lens 413 is mounted a mirror 44 which is arranged to reflect a photographic light from the document surface and then expose the master paper P absorbed and held by the front surface 43A of the exposure bed 43. The exposure bed 43 is provided downwardly thereof with a developing unit 45 for developing the exposed master paper P, and a fixing unit 46 connected thereto and adapted to fix and process the developed master paper P. A developing and fixing is processed by these units, the master paper P is discharged out of a master paper take-up port 47 formed downwardly of the front surface of the main body 40. A power source unit 48 is counted downwardly of the rear thereof to drive the entirety of the instant apparatus.

In this connection, it is noted that while the supply unit for the master paper P is shown in FIG. 1 as being for one roll, a double line supply unit may be fabricated by means of which the paper is fed through upper and lower rolls.

In such an electrophotographic processing machine, irregularity derived from cutting the tip of the master paper P or a portion thereof stained with dirt from hands is cut away when a new roll of the master paper P is installed so that it is necessary to feed the master paper P without dirtiness and in an unchanging condition.

For the accommodation of the aforementioned requirement, as shown in FIG. 2 (in this instance, the paper has been conventionally trained in a double line over upper and lower rolls 50 and 51), the master paper PU fed from the upper roll 50 has been conveyed through nip rollers 52 and 53 to a cutter 422 whereas the other master paper PD from the lower roll 51 has been transported through nip rollers 55, 56 and 53 to a cutter 422. Exposure of each of the rolls of master papers PU and PD starts at a position A. For example, when the tip of the master paper PU rolled off the upper roll 50 assumes the position A while the tip of the master paper PD rolled off the lower roll 51 is located at B2 on standby, the upper roll 50 can be removed due to shortage of paper and a fresh upper roll 50 loaded. Upon actuation of a start switch (not shown) for cutting the tip of the paper rolled off the newly loaded upper roll, the master paper PU is conveyed through the nip rollers 52 and 53 to a position where a cutter 422 is provided. Further, the master paper PU is conveyed for a predetermined distance (for example, more than about 600 mm as a whole) and its conveyance is terminated when the tip of the paper reaches the exposure bed 43 and is held in an absorced condition. At the same time, the cutter 422 is actuated to cut off the tip of the paper. Thus the cut paper tip end as absorbed on the exposure bed 43 is manually taken by the operater out of a take-up port (not shown) mounted on the exposure bed. After cutting and disposing of the tip of the master paper PU, the next tip of the master paper PU is returned to a position designated at 81 and is then kept on standby when the start switch is operated. Simultaneously the tip of the master paper PD which is rolled out of the lower roll 51 and held on standby is conveyed to the position A. Subsequently, the master paper is transported by predetermined distance and cut by the cutter 422.

Such a conventional electrophotographic processing machine has involved disadvantage in that the length of the tip cut from the master paper is more than about 600 mm which involves a great amount of loss and a high cost for the photographic processing. Labor is inevitably required for discarding paper tips every time the start switch for cutting off the paper tip is depressed, so that operability is lowered. Difficulty is involved in simultaneously conducting photographic processing with shifting the position of the paper tip incidental to the shifting of the upper and lower rolls.

SUMMARY OF THE INVENTION

The present invention has been provided in view of the circumstances discussed above. It is an object of the invention to provide a roll feeding apparatus for an electrophotographic processing machine which is designed such as to convey a predetermined amount of the tip of a roll of master paper and which is capable of reducing as much as possible the amount of paper to be cut to provide photographic processing which is low in cost.

According to one aspect of this invention, for achieving the objects described above, there is provided a roll paper feeding apparatus for an electrophotographic processing machine wherein master paper in a roll form is taken out by a group of nip rollers and conveyed by a conveyor means to an exposure position, said master paper being cut by a cutter disposed between said group of nip rollers and said conveyor means, characterized by being composed of a paper guide swingable in response to conveyance, cutting of said master paper, and paper that is wasted at the forward end thereof, and a waster paper collecting unit disposed downwardly of said paper guide.

The nature, principle and utility of the invention will become more apparent from the following detailed description when read in conjunction with the accompanying drawings.

DESCRIPTION OF THE PREFERRED EMBODIMENTS

Figure 1:
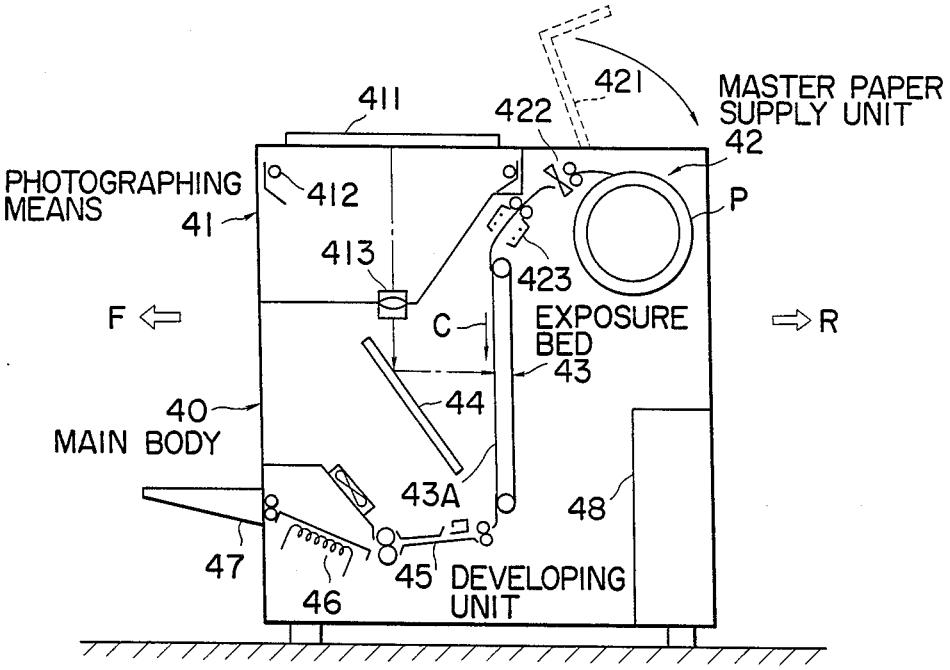
PRIOR ART FIG. 1
FIG. 1 is a structural view of one form of a conventional console type electrophotographic processing machine.
Figure 2:
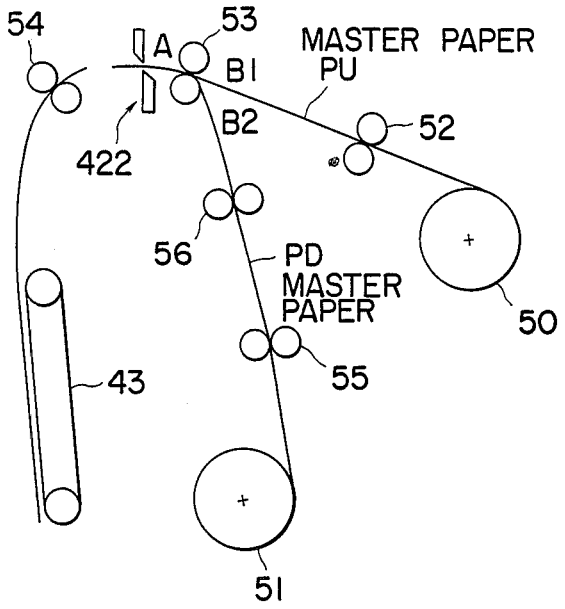
PRIOR ART FIG. 2
FIG. 2 is a representation functionally showing a portion of the above conventional apparatus.
Figure 3:
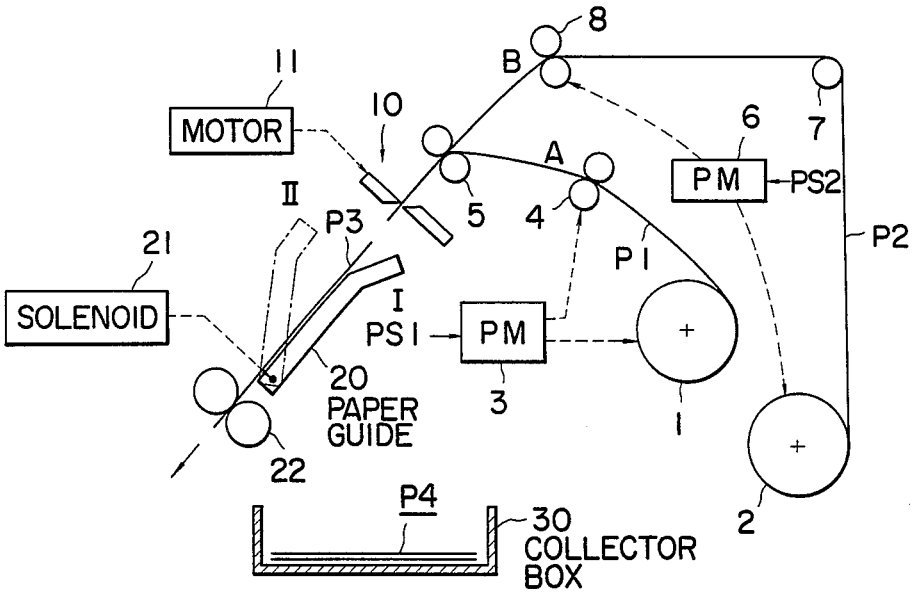
FIG. 3 is a structural view showing one embodiment of this invention.

FIG. 3 shows one embodiment of this invention, wherein master paper P1 rolled off an upper roll 1 is conveyed through nip rollers 4 and 5 to a position where a cutter 10 is provided. On the other hand, master paper 2 rolled off a lower roll 2 is transported through a driven roller 7 and nip rollers 8 and 5 to a position where the cutter 10 is disposed. The cutter 10 is adapted to cut the master paper which is conveyed by driving a cutter motor 11. The master paper P1 is transported by means of a puise motor 3 connected to the upper roll 1 and the nip roller 4 and the like while master paper P2 is conveyed by driving a pulse motor 6 connected to the lower roll 2 and the nip roller 8 and the like. The pulse motors 3 and 6 are respectively adapted for movement in response to pulse signals PS1 and PS2 as instruction signals sent from a control device (not shown). The master paper which passes the cutter 10 is conveyed by conveyor rollers 22 in the direction of an exposure bed as aforementioned. A paper guide 20 is disposed between the cutter 10 and the conveyor rollers 22 for guiding the master paper to be conveyed. The paper guide 20 is adapted for swingable movement between positions I and II when driven by a solenoid 21. The paper guide 20 is provided downwardly thereof with a collector box 30 for collecting wasted paper P4 which consists of the tips cut from the roll of paper.

Figure 4:
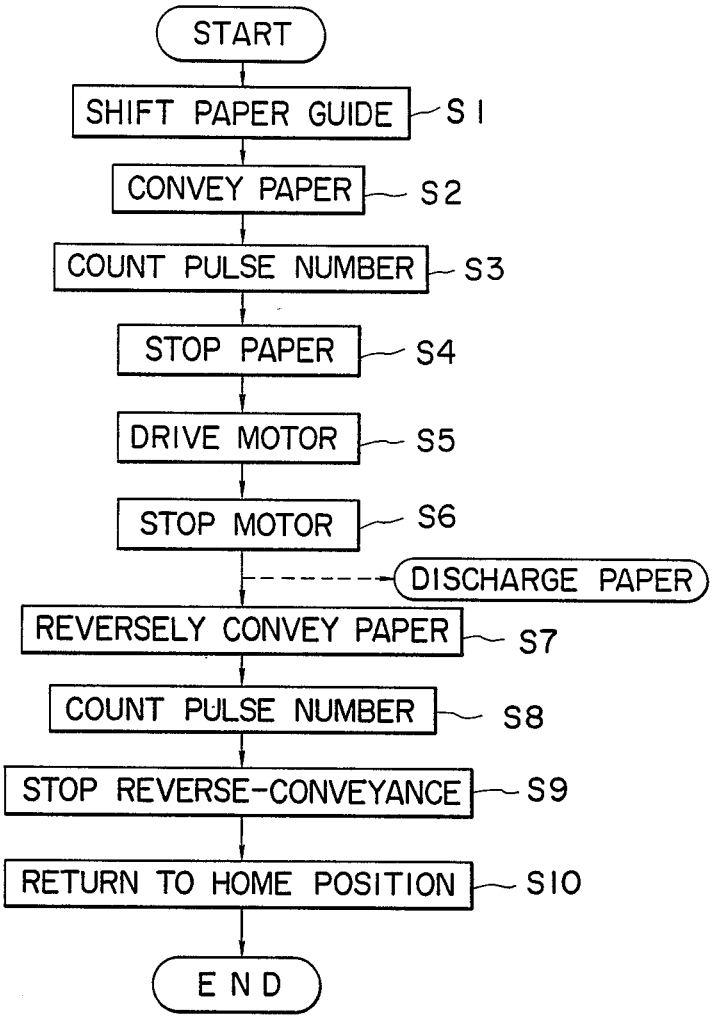
FIG. 4 is a flow chart showning the functional state of the embodiment.

The operation derived from the aforementioned arrangement will be explained with reference to the flow chart shown in FIG. 4.

The master paper rolled off the upper and lower rolls has the tips thereof held on standby in positions A and B. In this connection, it is noted that the paper guide 20 assumes the position I as shown when normal exposure and development are made. In contrast, when a fresh roll is loaded such as to render the paper tip master, the paper guide 20 is shifted to the position II as shown by driving the solenoid 21 under operation of the start switch for cutting the paper tip (Step S1). For instance, the tip of the master paper P1 is conveyed through the nip rollers 4, 5 and the cutter 10 in the direction of the paper guide 20 where it is located (Step S2). The master paper P1 is conveyed by driving the pulse motor 3 so that the amount of master paper P1 may be measured by counting the number of pulses generated from the pulse signal PS1 supplied to the pulse motor 3 (Step S1). When the tip of the master paper P1 is run to such an extent as to reach the neighborhood of the paper guide 20, the running of the paper is terminated (Step S4) and the cutter motor 11 is then driven to operate the cutter 10 (Steps S5 and S6). Upon cutting the master paper P1 under operation of the cutter 10, the tip of the master paper drops off and is collected in the downwardly located collector box 30. In this instance, the paper guide 20 is in the position II as shown so that the tip cut from the master paper positively drops and is collected in the collector box 30 without reaching the conveyor rollers 22.

After cutting the tip from the paper, in the manner aforementioned, the pulse motor 3 is reversely rotated (Step S7) such as to return the tip of the master paper P1 which has reached the position where the cutter 10 is located, to a standby position A (Steps S8 and S9), thereby allowing the pulse motor 3 to stop. At the same time, the solenoid 21 is driven such as to swing the paper guide 20 so as to return the latter from position II to position I (Step S10). Under such a condition, the pulse motor 3 or 6 is driven in the normal direction such as to convey the master paper P1 or P2 to the starting position A or B in a predetermined amount. The master paper is then cut by the cutter 10 in a predetermined length and subjected to exposure operation as aforementioned. The wasted tips or pieces of paper collected in the collector box 30 may be manually discharged by the operator or the like when a certain amount has accumulated.

Although the embodiment has been described with reference to the wasted tips of the master paper P1, the master paper P2 is process in the same manner as is the case of the other master paper P1. The aforementioned electrophotographic processing machine may be applied to console and camera type electrophotographic processing machines. The paper guide and its drive mechanism may be modified to various types of guides and drive mechanisms. Although the upper and lower rollers are driven by separate motors, they may also be commonly driven by one pulse motor.

According to the roll paper feeding apparatus of the present invention, the tip of the master paper which has to be disposed of as waste is very short (for example about 50~100 mm). This keeps costs low and does not require discharge of paper tips every time the paper is cut, thus helping the operator. The paper tip is normally positioned on standby such as to advantageously enable starting of the photographic processing simultaneously with shifting of the upper and lower rolls.

It should be understood that many modifications and adaptations of the invention will become apparent to those skilled in the art and it is intended to encompass such obvious modifications and changes in the scope of the claims appended hereto.

What is claimed is:

1. A roll paper feeding apparatus for an electrophotographic processing machine wherein master paper in a roll form is taken out by a group of nip rollers and conveyed by a conveyor means to an exposure position, said master paper being cut by a cutter disposed between said group of nip rollers and said conveyor means, characterized by being composed of a paper guide swingable in response to conveyance, cutting of said master paper, and paper that is wasted at the forward end thereof, and a wasted paper collecting unit disposed downwardly of said paper guide.

2. A roll paper feeding apparatus for an electrophotographic processing machine according to claim 1 wherein said master paper is trained in a double line such as to be fed from upper and lower rolls.

3. A roll paper feeding apparatus for an electrophotographic processing machine according to claim 1 wherein said conveyor means is formed of a pulse motor, and wherein the amount of said master paper as conveyed is measured by counting the amount of pulses fed to said pulse motor.

4. A roll paper feeding apparatus for an electrophotographic processing machine according to claim 1 wherein the swingable movement of said paper guide is controlled by an electromagnetic means.

5. A roll paper feeding apparatus for an electrophotographic processing machine according to claim 1 wherein said electromagnetic means is a

6. A roll paper feeding apparatus for an electrophotographic processing machine according to claim 2 whrein said conveyor means for said master paper in a double line is formed of respective pulse motors, and wherein the amount of said master papers in a double line as conveyed is measured by counting the amount of pulses fed to each of said pulse motors.

7. A roll paper feeding apparatus for an electrophotographic processing machine according to claim 2 wherein said conveyor means for said master paper in a double line is formed of one common pulse motor, and wherein the amount of said master paper in a double line is measured by counting the amount of pulses fed to said pulse motor.

8. A roll paper feeding apparatus for an electrophotographic processing machine according to claim 1 wherein said conveyor means is reversed such as to allow the forward end position of said master paper to serve as a predetermined position thereof.

* * * * *